US007177584B2

(12) United States Patent
Johnson

(10) Patent No.: US 7,177,584 B2
(45) Date of Patent: Feb. 13, 2007

(54) DETERMINING A MEDIA FEATURE

(75) Inventor: Jon Johnson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 10/842,168

(22) Filed: May 10, 2004

(65) Prior Publication Data

US 2005/0249535 A1 Nov. 10, 2005

(51) Int. Cl.
*G03G 15/00* (2006.01)

(52) U.S. Cl. ..... 399/389; 399/388

(58) Field of Classification Search ..... 399/389, 399/388, 220, 221, 381, 383
See application file for complete search history.

(56) References Cited

U.S. PATENT DOCUMENTS

| | | | | |
|---|---|---|---|---|
| 4,002,919 | A * | 1/1977 | Linard | 250/559.19 |
| 4,255,057 | A | 3/1981 | Williams | |
| 4,352,988 | A | 10/1982 | Ishida | |
| 4,461,576 | A | 7/1984 | King | |
| 4,723,072 | A * | 2/1988 | Naruse | 235/454 |
| 4,931,826 | A | 6/1990 | Lucht et al. | |
| 5,084,627 | A * | 1/1992 | Ueki et al. | 250/559.4 |
| 5,280,171 | A | 1/1994 | Halter | |
| 5,903,339 | A * | 5/1999 | Levasseur | 356/71 |
| 6,097,497 | A | 8/2000 | McGraw | |
| 6,192,141 | B1 | 2/2001 | Ahn | |
| 6,231,503 | B1 * | 5/2001 | Sugimoto et al. | 600/178 |
| 6,291,829 | B1 | 9/2001 | Allen et al. | |
| 6,385,352 | B1 | 5/2002 | Roustaei | |
| 6,521,905 | B1 * | 2/2003 | Luxem et al. | 250/559.09 |
| 6,633,740 | B2 | 10/2003 | Estabrooks | |
| 6,960,777 | B2 * | 11/2005 | Soar | 250/559.11 |
| 2003/0193016 | A1 * | 10/2003 | Chin et al. | 250/231.13 |

FOREIGN PATENT DOCUMENTS

| | | |
|---|---|---|
| EP | 0900754 A1 | 3/1999 |
| EP | 1189035 A2 | 3/2002 |
| JP | 56155136 | 12/1981 |
| JP | 6074828 | 3/1994 |
| JP | 7208933 | 8/1995 |
| JP | 8247730 | 9/1996 |
| JP | 2000289888 | 10/2000 |
| TW | 041146 B | 11/2000 |

* cited by examiner

*Primary Examiner*—Anthony H. Nguyen

(57) ABSTRACT

A method for determining a media feature includes directing light toward a media path and a reflector. The reflector converges the light on a light detector. Intensity data is collected from the light detector and analyzed to determine the media feature.

16 Claims, 14 Drawing Sheets

DETERMINING A MEDIA FEATURE

BACKGROUND

Image forming devices are capable of printing images on media sheets of varying widths. Printing beyond the edges of a media sheet can cause a number of problems. It wastes imaging material such as ink toner. The wasted imaging material can damage or decrease the life span of the image forming device. The wasted imaging material can be inadvertently transferred to another media sheet degrading print quality.

DETAILED DESCRIPTION

INTRODUCTION: A given image forming device can be capable of printing on media having varying features. Examples of features include width as well as the presence and location of holes, and defects such as tears. To extend the life of the device, help reduce waste of imaging material such a toner or ink, and to help achieve a desired level of print quality, the image forming device may be made aware of the features of the media on which it is about to print. Various embodiments function to identify the width and other features of a sheet of print media.

The following description is broken into sections. The first section, labeled "components," describes an example of the physical and logical components of an image forming device in which various embodiments of the invention may be implemented. The second section, labeled "Media Width" describes an exemplary series of method steps and examples for detecting the width of a sheet of print media. The third section, labeled "Identifying Holes" describes an exemplary series of method steps and examples for detecting the presence of a hole in a sheet of print media. The fourth section, labeled "Locating Holes," describes an exemplary series of method steps and examples for identifying the location and size of a hole in a sheet of print media.

Figure 1:
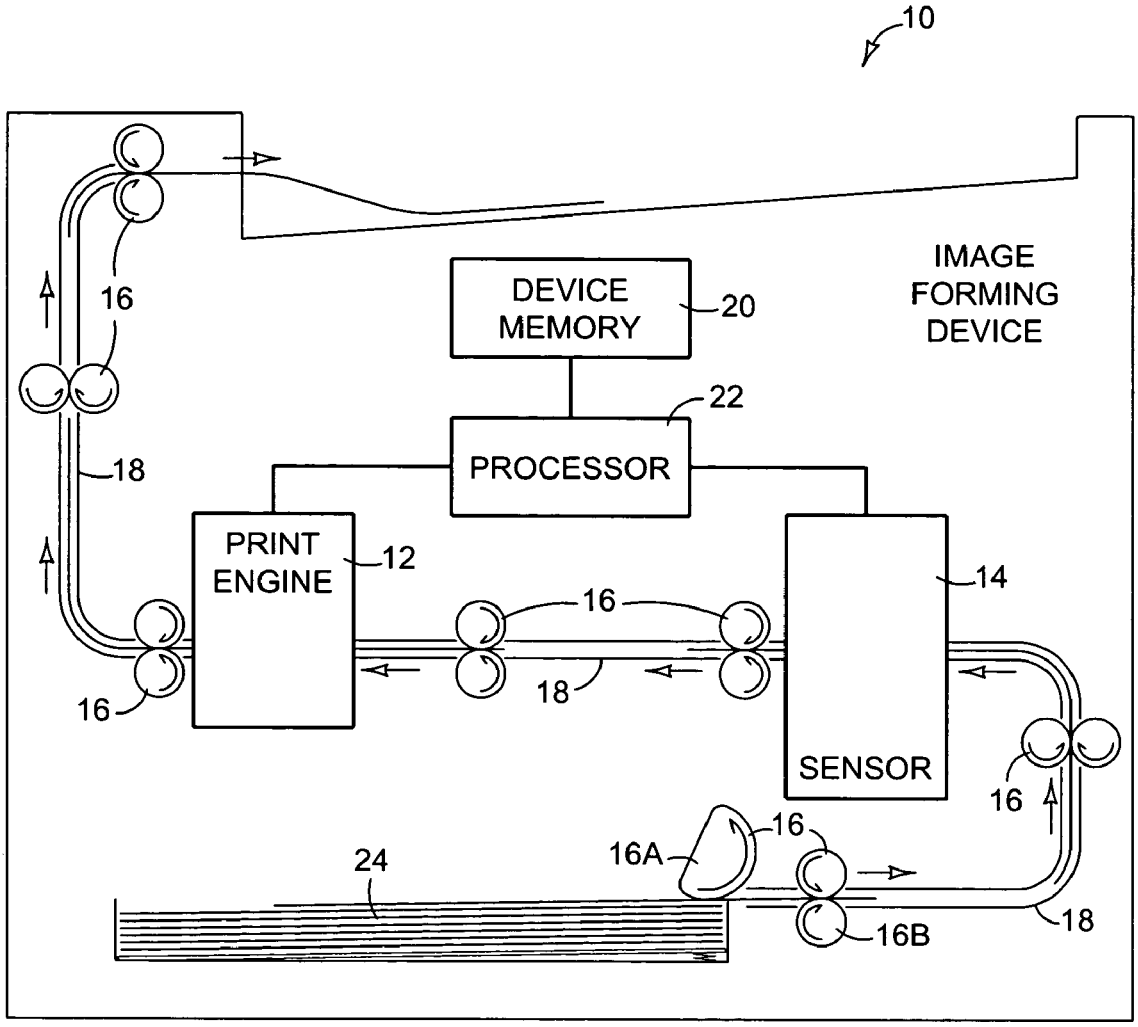
FIG. 1 is a block diagram of an exemplary image forming device in which various embodiments of the present invention may be implemented.

COMPONENTS: FIG. 1 illustrates an exemplary image forming device 10 in which various embodiments of the present invention may be implemented. Image forming device 10 represents generally any device capable of forming an image on a sheet of paper or other print media. Image forming device 10 includes print engine 12, sensor 14, media drive 16, media path 18, device memory 20, and processor 22.

Print engine 12 represents generally the hardware components capable of forming an image on print media. Where, for example, image forming device 10 is a laser printer, print engine 12 may include a laser, a fuser, and a toner cartridge housing a toner reservoir, a photoconductive drum, a charging device, and a developer. In operation, the charging device places a uniform electrostatic charge on a photoconductive drum. Light from the laser is scanned across the photoconductive drum in a pattern of a desired print image. Where exposed to the light, the photoconductive drum is discharged creating an electrostatic version of the desired print image. The developer transfers charged toner particles from the toner reservoir to the photoconductive drum. The charged toner particles are repelled by the charged portions of the photoconductive drum but adhere to the discharged portions. The charge roller charges or discharges the print media sheet. As the media sheet passes across the photoconductive drum, toner particles are then transferred from the photoconductive drum to the media sheet. The fuser thermally fixes the transferred toner particles to the media sheet.

Where, for example, image forming device 10 is an ink printer, print engine 12 might include a carriage and an ink cartridge housing an ink reservoir and one or more print heads. In operation the print heads selectively eject ink from the ink reservoir onto a media sheet according to a desired print image. The carriage selectively moves and positions the print head relative to a media sheet such that the ejected ink forms the desired print image.

Figure 3:
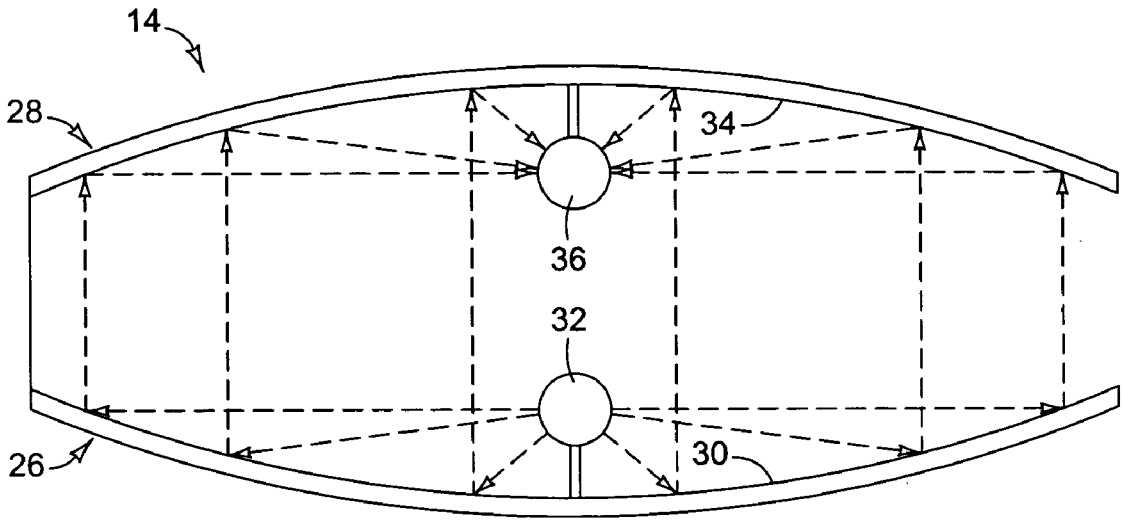
FIGS. 3–6 are side views of the exemplary parabolic emitter and parabolic detector of FIG. 2.

Sensor 14, described in more detail below with reference FIG. 3, represents hardware components capable of being used to identify one or more print media features by detecting the intensity of a light beam directed across media path 18. Media drive 16 represents the hardware components capable of urging print media along media path 18. Media path 18 represents generally the path along which print media flow through image forming device 10 during a printing operation.

Device memory 20 represents generally any computer readable medium or media capable of storing programs and data for controlling the operation of print engine 12, sensor 14 and media drive 16. Examples of programs stored by device memory 20 are described below with reference to FIG. 9. Processor 22 represents generally any processor capable of executing programs contained in device memory 20.

As shown, media drive 16 includes pick roller 16A and pinch rollers 16B. Pick roller 16A is responsible for selectively feeding print media from media source 24 into media path 18. Pinch rollers 16B are responsible for urging print media along media path 18 past sensor 14 and print engine 12. As shown, sensor 14 is located upstream from print engine 12 along media path 18. In this manner sensor 14 can be used to identify a print media feature and then the operation of print engine 12 can be directed according to the identified feature. For example, where the feature is a width of the print media, print engine 12 can be directed not to print beyond the edges of the print media.

Figure 2:
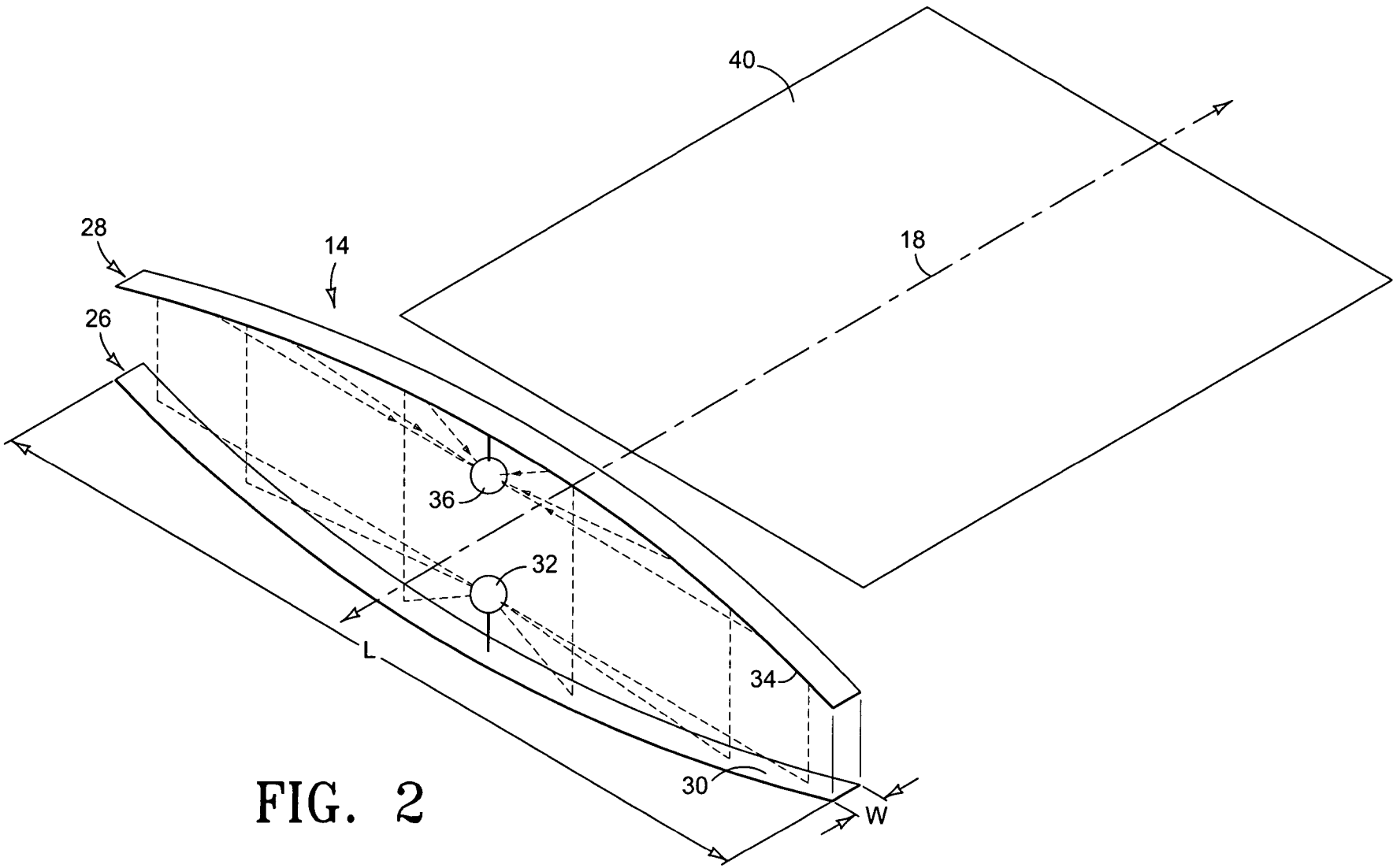
FIG. 2 is a perspective view of an exemplary sensor according to an embodiment of the present invention.

FIGS. 2–8 help to illustrate example embodiments of sensor 14. Referring first to FIG. 2, sensor 14 includes emitter 26 and an opposing detector 28. Emitter 26 includes reflector 30 and light emitter 32. Light emitter 32 is a light source placed at the focal point of reflector 30. Detector 28 includes reflector 34 and light detector 36. Light detector 36 is placed at the focal point of reflector 34 such that reflector 34 can converge light on light detector 36. Reflectors 30 and 34 may, for example, be parabolic reflectors.

Light detector 36 represents generally any device capable of producing an output signal that is proportional to the intensity of the light it measures. In other words, as the intensity level changes, so does the output signal from light detector 36. The output signal of light detector 36 may, for example be a voltage level. As the measured light intensity increases or decreases, the voltage level increases or decreases. A change in intensity can then be identified by a change in voltage.

As shown, emitter 26 and detector 28 are positioned on opposite sides of media path 18. Emitter 26 is aimed to direct a beam of light across media path 18. Detector 28 is aimed to receive and detect the intensity of that beam of light. As media sheet 40 travels along media path 18 and passes between emitter 26 and detector 28, at least a portion of the light beam will be blocked, decreasing the light intensity measured by detector 28.

In the example shown, reflectors 30 and 34 are substantially of the same overall size. Each, for example, may be a cross sectional slice of a parabolic dish having a width dimension W and a length dimension L. W, for example, can be chosen to match the approximate sizes of light emitter 32 and light detector 36—$1/16^{th}$ of an inch or smaller in some cases. L is chosen so that reflectors 30 and 34 span across at least a portion of a width of media path 18.

Figure 4:
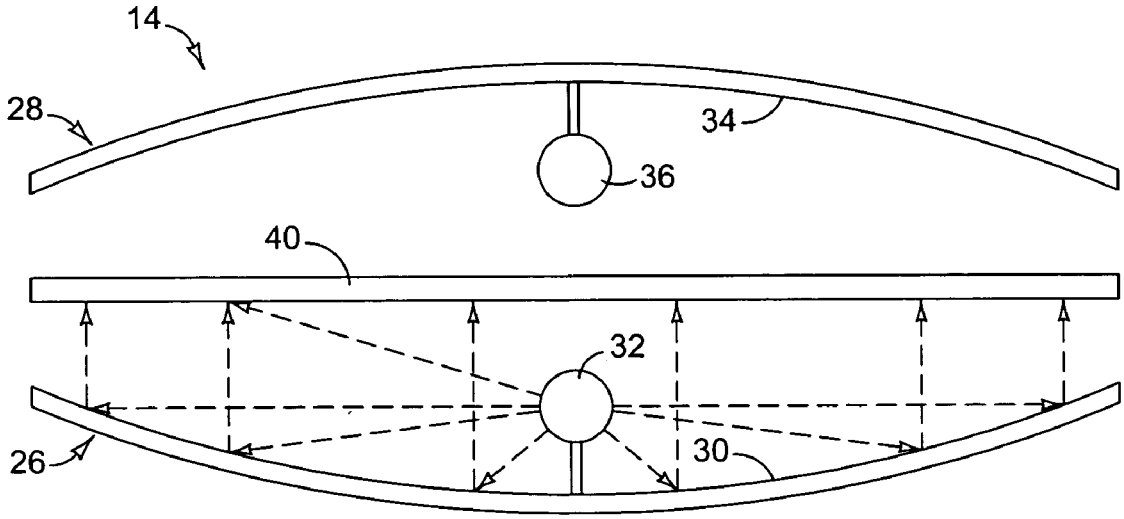
Figure 5:
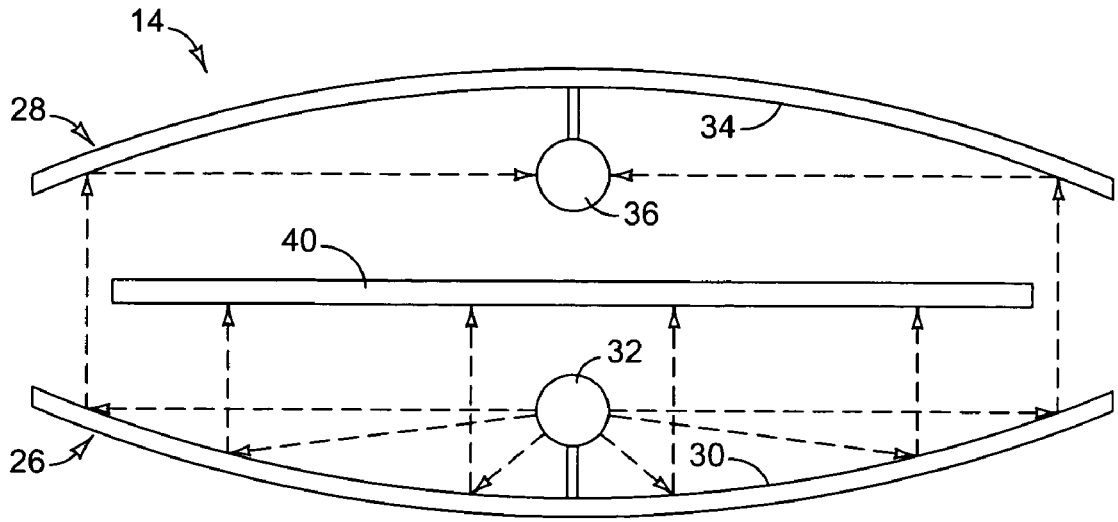
Figure 6:
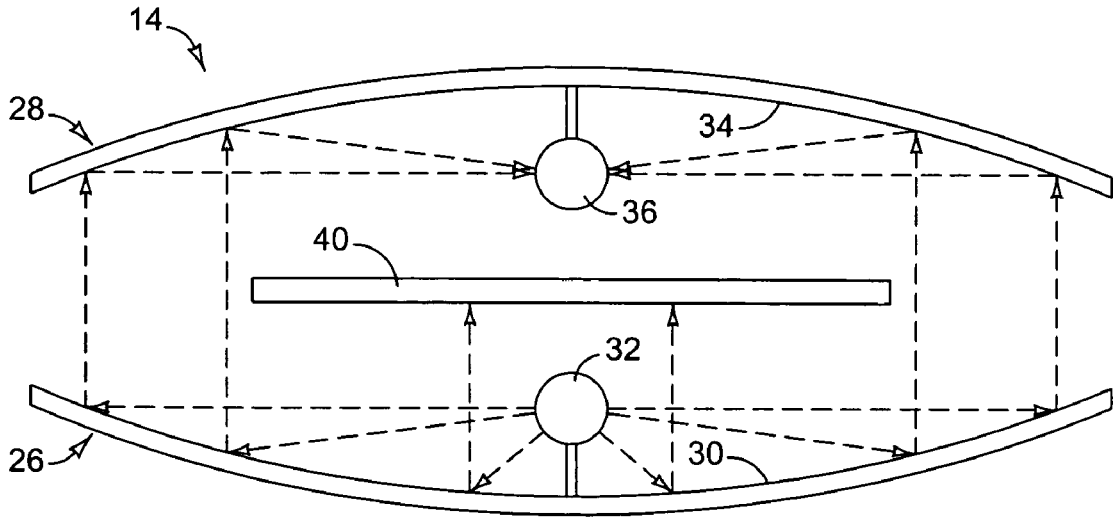

FIG. 3 illustrates a front view of sensor 14 in which a light beam emitted from emitter 26 is unobstructed, so the light intensity measured by detector 28 will be at a relatively high value. In FIG. 4, media sheet 40 has a width that completely blocks the light beam, so light intensity measured by detector 28 will be at a relatively low value. In FIG. 5, media sheet 40 has a smaller width that lets some of the light beam pass. In FIG. 6, media sheet 40 has an even smaller width that lets even more of the light beam pass.

Figure 7:
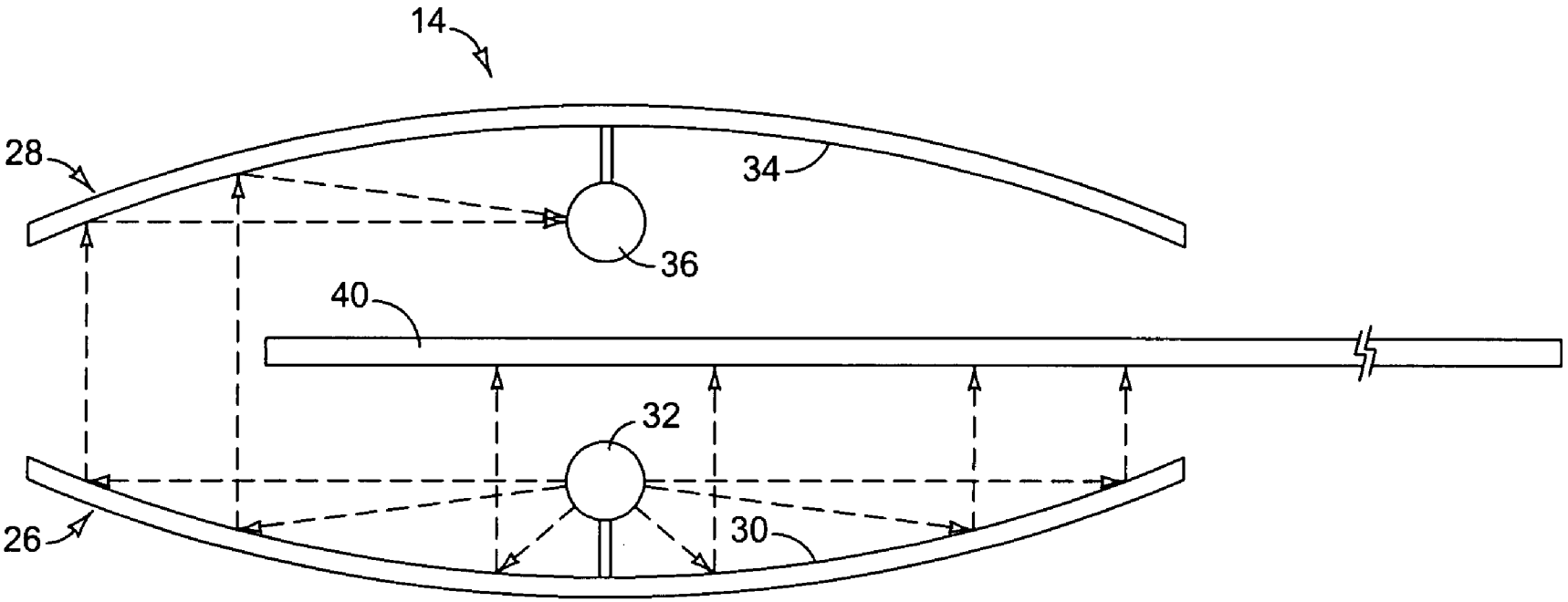
FIG. 7 is a side view of an exemplary parabolic emitter and exemplary parabolic detector in which a print media edge passes between the emitter and the scanner according to an embodiment of the present invention.
Figure 8:
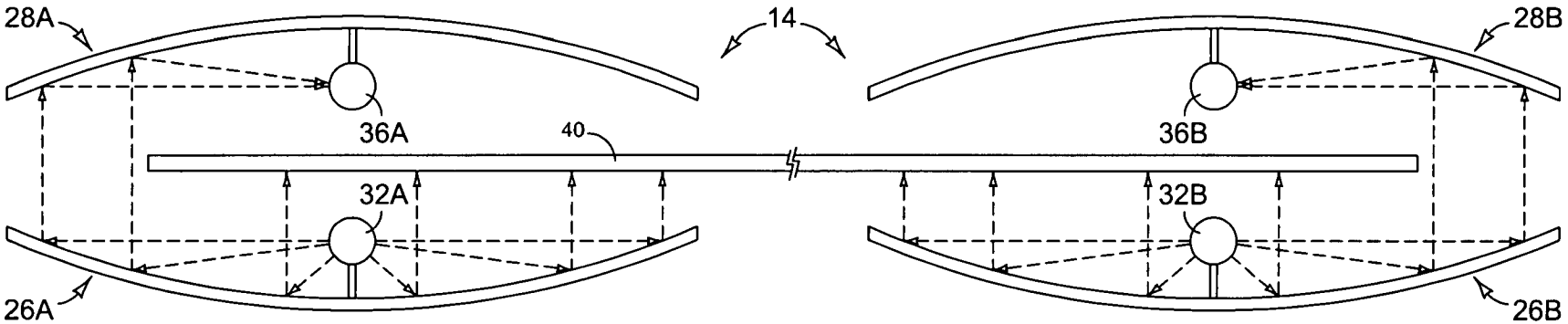
FIG. 8 is side view illustrating a pair of exemplary parabolic emitters and exemplary parabolic detectors in which a different print media edge passes between each emitter and detector pair according to an embodiment of the present invention.

FIG. 7 helps illustrate another manner for utilizing sensor 14. Here an edge of media sheet 40 passes between emitter 26 and detector 28. In FIG. 8, sensor 14 includes two emitters 26A and 26B and two detectors 28A and 28B. Emitters 26A, 26B and detectors 28A, 28B are positioned and aimed such that opposing edges of media sheet 40 pass between each emitter and detector pair 26A, 28A and 26B, 28B.

Figure 9:
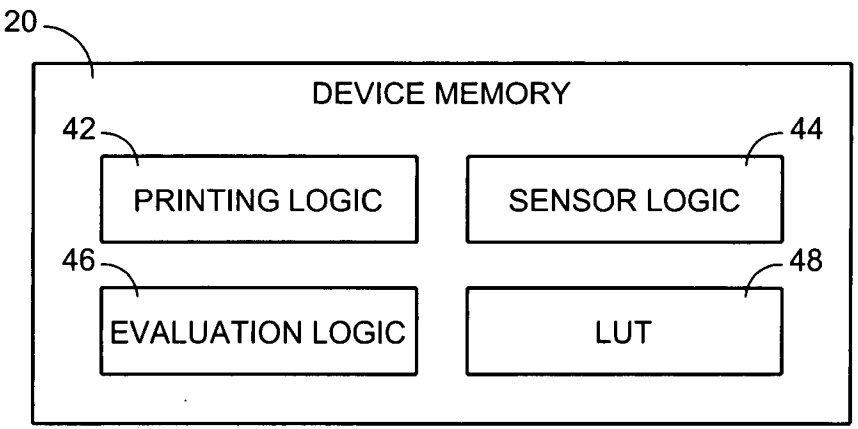
FIG. 9 is an exemplary block diagram illustrating the logical program elements for implementing various embodiments of the present invention.

Turning now to FIG. 9, device memory 20 includes printing logic 42, sensor logic 44, evaluation logic 46 and LUT (Look Up Table) 48. Printing logic 42 represents generally any program or programs capable of directing media drive 16 (FIG. 1) to urge a print media sheet along paper path 18 past print engine 12 as well as any program or programs capable of directing print engine 12 to form or to not form a desired image on the print media.

Sensor logic 44 represents generally any program or programs capable of collecting intensity data from sensor 14 (FIG. 1). At discrete points in time, sensor 14 generates a signal corresponding to a measured light intensity. The value of the signal at each point in time is referred to as intensity data. Also, a series of such values obtained over a time period is also referred to as intensity data.

Evaluation logic 46 represents generally any program or programs capable of analyzing intensity data to identify a print media feature. Examples of such features include print media width, the presence of a hole, and the size and location of a hole. When performing its function, evaluation logic 46 may access and use data contained in LUT 48. For example, evaluation logic 46 may access an entry in LUT 48 that corresponds to intensity data collected by sensor logic 44. That entry might then contain data identifying a print media feature or data to be used to calculate the print media feature.

Figure 10:
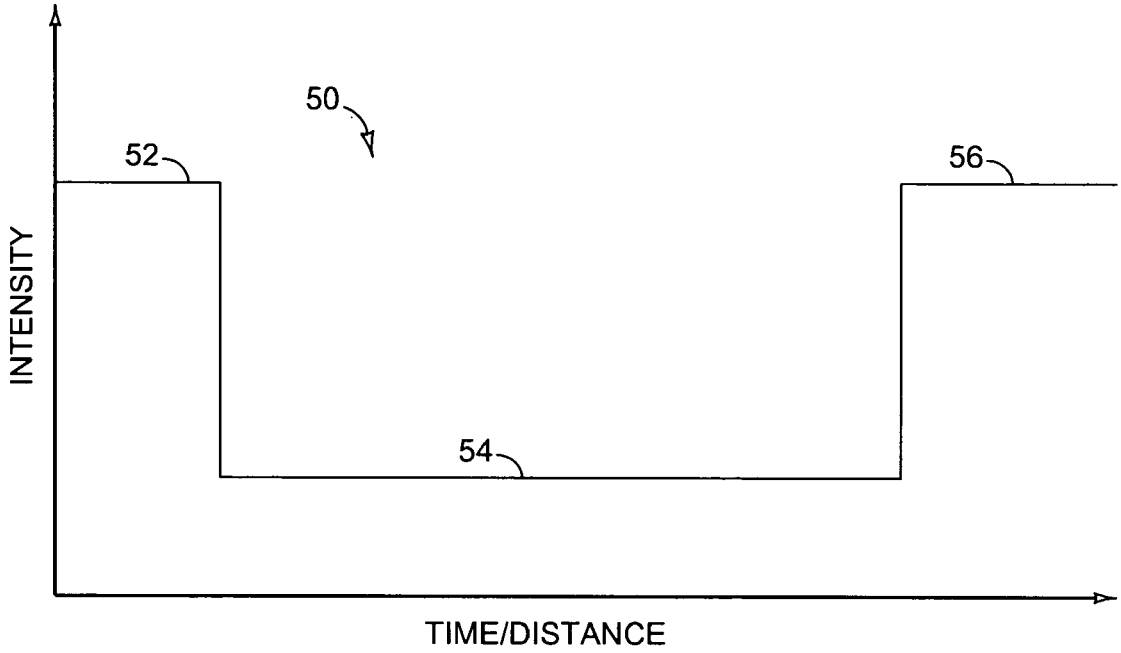
FIG. 10 is an exemplary two-dimensional graph charting intensity value as a media sheet with no holes passes a sensor according to an embodiment of the present invention.
Figure 11:
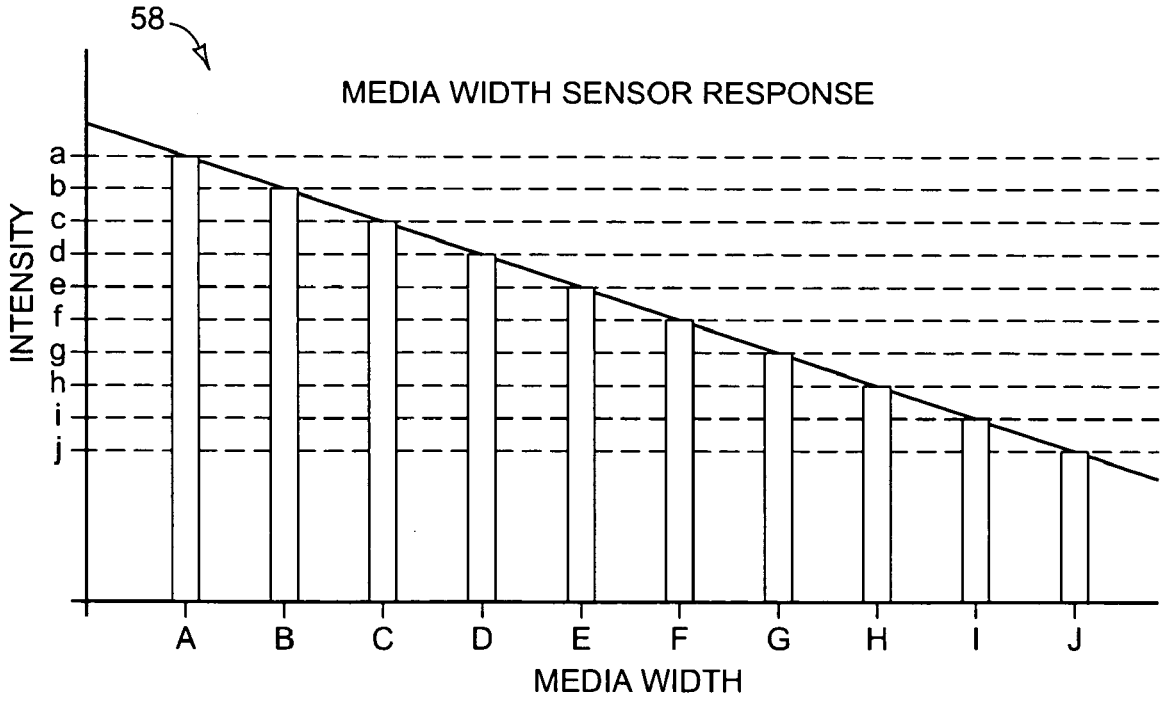
FIG. 11 is an exemplary chart illustrating how detected light intensity can vary based on media width according to an embodiment of the present invention.
Figure 12:
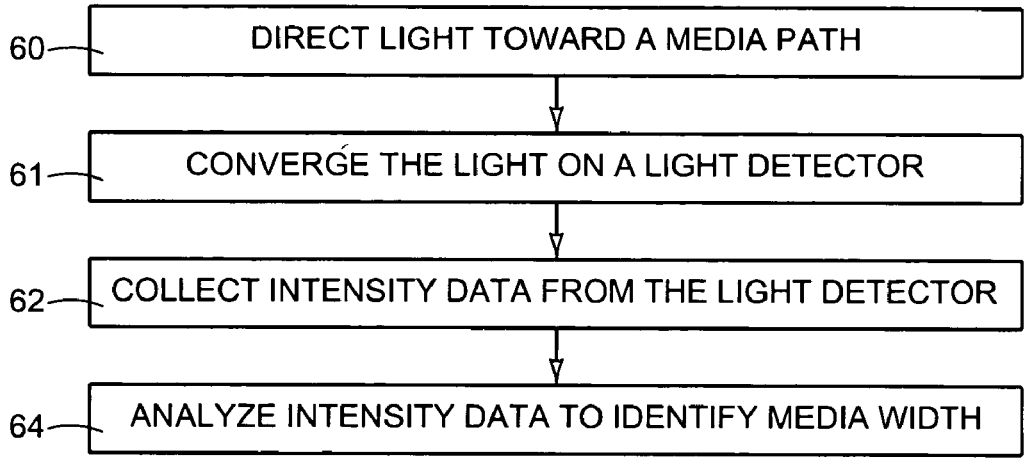
FIG. 12 is an exemplary flow diagram illustrating steps taken to identify a media width according to an embodiment of the present invention.

MEDIA WIDTH: FIGS. 10–12 helps illustrate a method for identifying a media width based on an intensity level measured by sensor 14 (FIG. 1). FIG. 10 is a two-dimensional graph 50 illustrating a measured intensity level as a media sheet passes through sensor 14. Initially the measured intensity level is at a relatively high value 52. When a leading edge of the media sheet enters sensor 14, the measured intensity level drops to a relatively low value 54. Once the trailing edge exits sensor 14, the measured intensity returns to a relatively high value 56. The width of the print media can be calculated as a function of the measured intensity level. The presence of relatively low level 54 indicates a media width of a discernable value.

Media width sensor chart 58 of FIG. 11 helps illustrate how detected light intensity can vary based on media width. LUT 48 (FIG. 9) may include ten entries identifying different media widths A–J. Each entry can be identified by data corresponding to a different intensity value. For example, the entry identifying media width (A) can be identified by data corresponding to intensity value (a) and so on. When intensity data collected by sensor logic 44 indicates a change in measured light intensity from a relatively high value to a relatively low value, the intensity data corresponding to that relatively low value can be used by evaluation logic 46 to access an entry in LUT 48 that identifies a media width.

FIG. 12 is an exemplary flow diagram illustrating method steps for identifying print media width. Light is directed toward a media path (step 60). The light beam is directed from a first side of the media path such that the beam spans at least a portion of a width of a media path. The light is converged on a light detector (step 61). Intensity data is collected from the light detector (step 62). The intensity data collected corresponds to an intensity measured from a second side of the media path opposite the first side as print media is urged along the media path. The intensity data is analyzed to identify a width of the print media (step 64).

Figure 13:
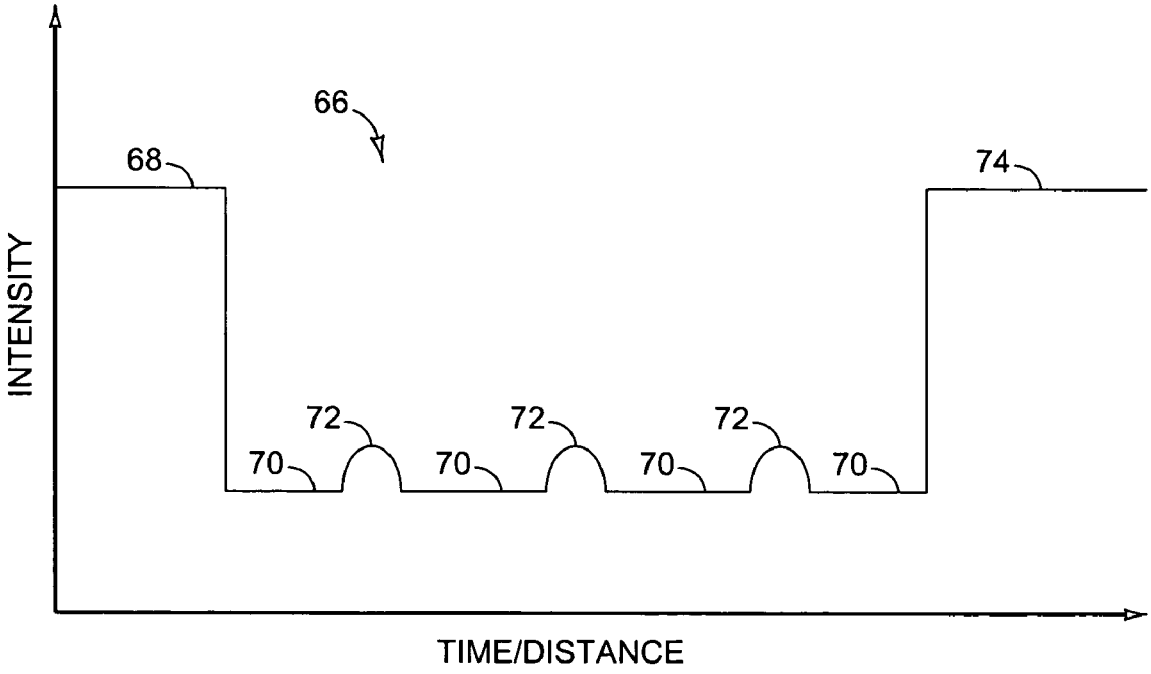
FIG. 13 is an exemplary two-dimensional graph charting intensity value as a media sheet with three holes passes a sensor according to an embodiment of the present invention.

IDENTIFYING HOLES: FIGS. 13–16 help illustrate a method for identifying holes in print media based on collected intensity data. FIG. 13 is a two-dimensional graph 66 illustrating a measured intensity level as a media sheet with three holes passes through sensor 14 (FIG. 1). Initially the measured intensity level is at a relatively high value 68. When a leading edge of a media sheet enters sensor 14, the measured intensity level drops to a relatively low value 70. Intensity changes 72 correspond to the three holes. As a segment of the media sheet with a hole enters, passes through, and then exits sensor 14, the measured light intensity increases and then decreases back to the relatively low value 70. Once the trailing edge exits sensor 14, the measured intensity returns to a relatively high value 74.

The existence of a hole can be identified by noting a first change in intensity from the relatively high value 68 to the relatively low value 70 and then a second change in which the measured intensity increases to a value less than the relatively high value and returns to the relatively low value. Analyzing the second change can reveal whether or not the second change resulted from a hole rather than a tear or other defect. Intensity change graph 76 of FIG. 14 helps illustrate.

Figure 14:
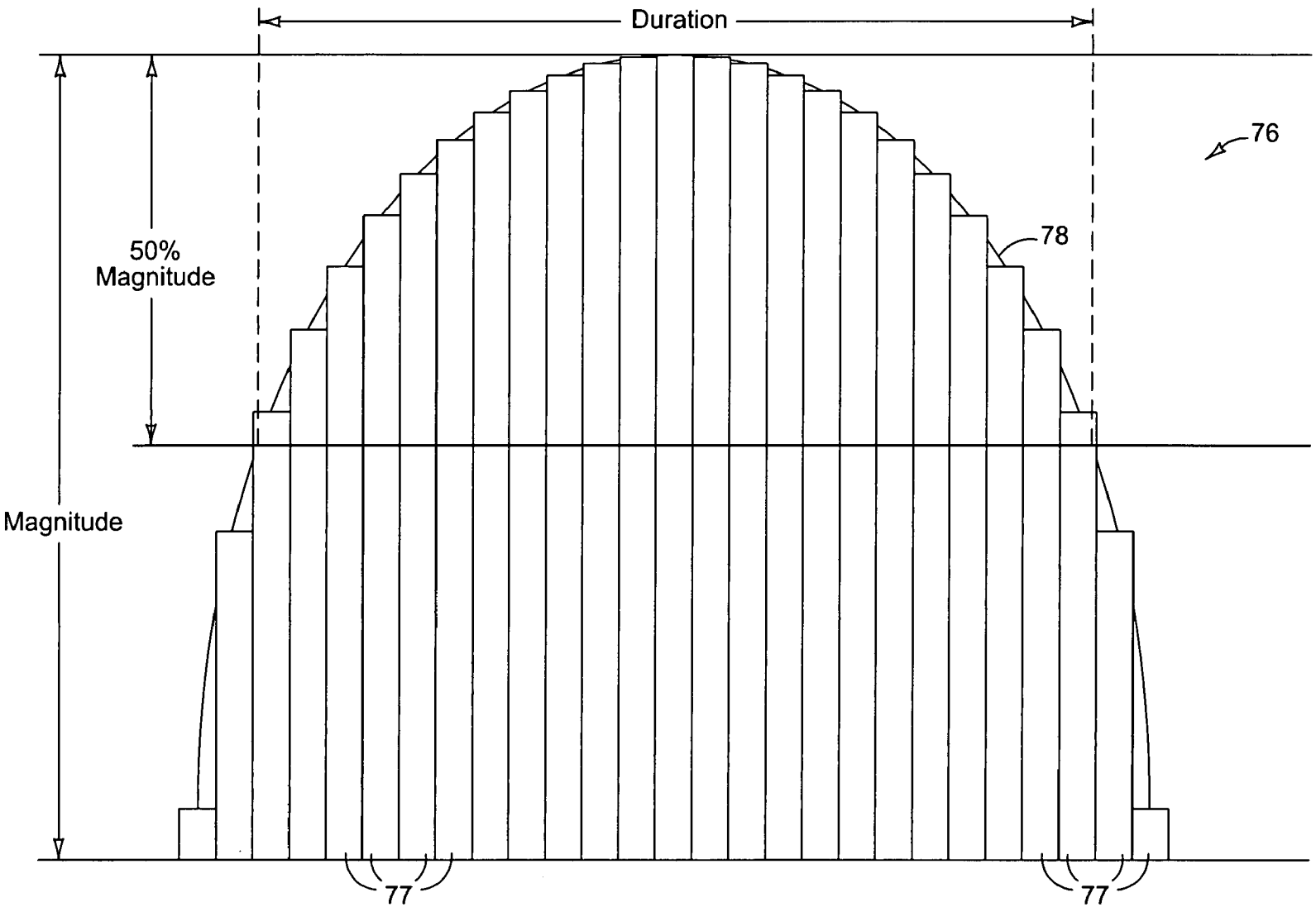
FIG. 14 is an exemplary two dimensional graph charting a change in intensity caused by a hole according to an embodiment of the present invention.

Graph 76 charts a change in measured intensity resulting from a hole. Chart 76 includes a series of segments 77 each corresponding to a measured intensity at a given point in time. A curve 78 is defined by a series of points representative of the intensity change indicated by each segment 77 as a function of time. Curve 78 has a magnitude and a duration as indicated in FIG. 14. The indicated duration is the duration for which the intensity change is equal to or greater than fifty percent of the magnitude. A suspected diameter can be determined based on the magnitude—a particular magnitude indicates a corresponding diameter. Using the velocity at which the print media travels through sensor 14 (FIG. 1), a width corresponding to the indicated duration can be calculated. The cause of the intensity change represented by curve 78 can then be confirmed to be a hole if that width equals approximately eighty-six percent of the suspected diameter.

Figure 15:
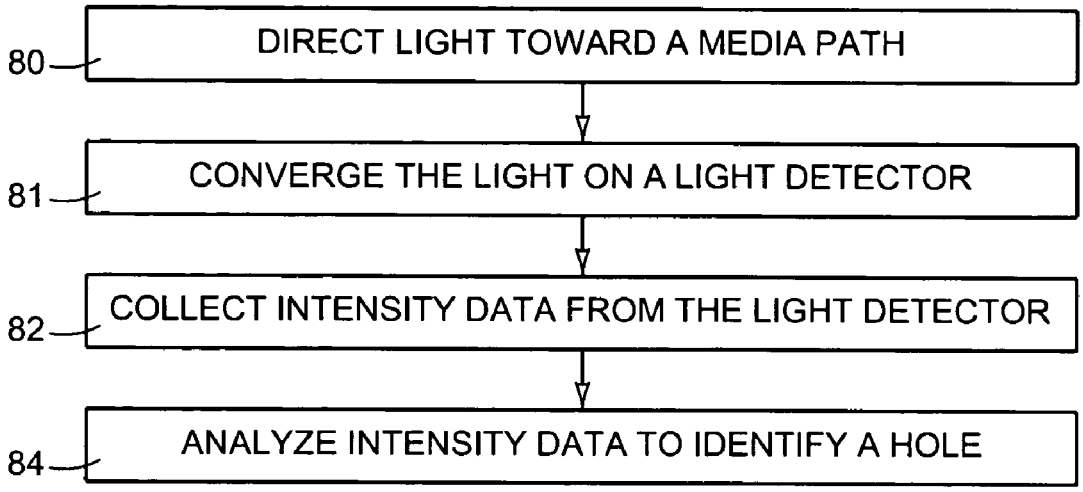
FIG. 15 is an exemplary flow diagram illustrating steps taken to identify a hole according to an embodiment of the present invention.

FIG. 15 is an exemplary flow diagram illustrating method steps for identifying a hole. Light beam is directed toward a media path (step 80). The light beam is directed from a first side of the media path such that the beam spans at least a portion of a width of a media path. The light is converged on a light detector (step 81). Intensity data is collected from the light detector (step 82). The intensity data collected corresponds to an intensity measured from a second side of the media path opposite the first side as print media is urged along the media path. The intensity data is analyzed to identify the presence of a hole (step 84).

Figure 16:
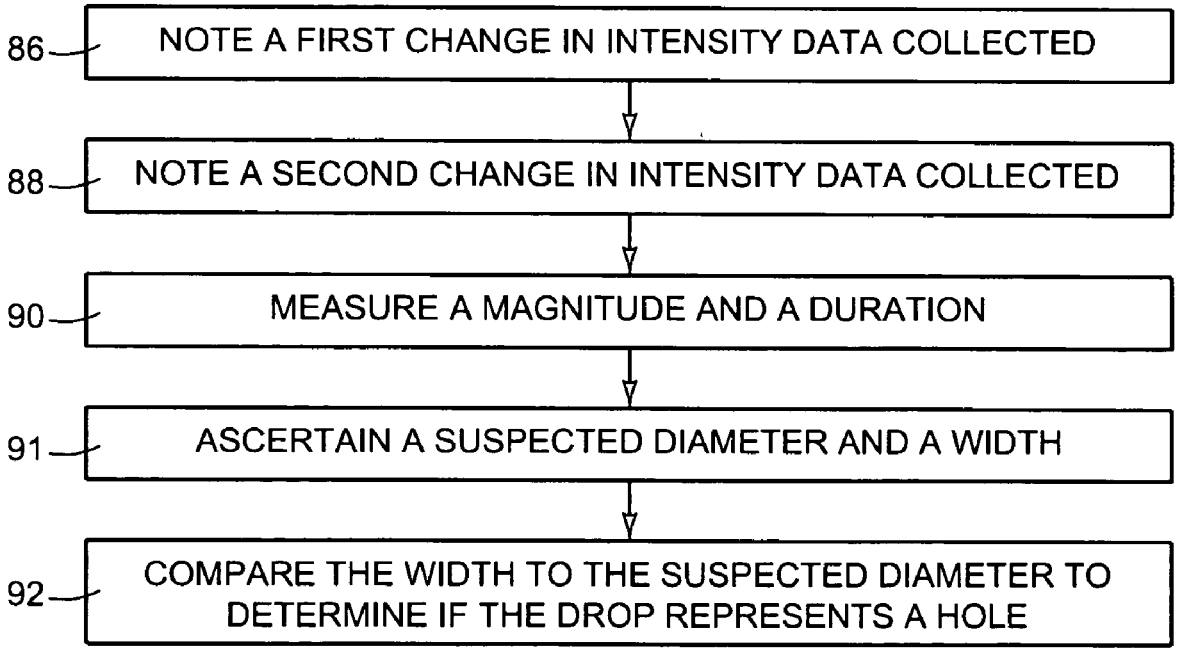
FIG. 16 is an exemplary flow diagram illustrating steps taken to determine if a change intensity data represents a hole according to an embodiment of the present invention.

FIG. 16 is an exemplary flow diagram expanding on step 84. A first change in intensity data collected is noted (step 86). The first change, for example, may be a change from a relatively high value to a relatively low value indicating that the leading edge of a media sheet has been detected. A second change in the collected intensity data is then noted (step 88). The second, change, for example, may be an increase from the relatively low value to a value less than the relatively high value. The magnitude of the second change and a duration for which the second change is equal to or greater than fifty percent of the magnitude are measured (step 90). A suspected diameter corresponding to the magnitude and a width corresponding to the duration are ascertained (step 91). The suspected diameter and the width are compared to determine if the second change was caused by a hole (step 92). Where the width is approximately equal to eight-six percent of the suspected diameter, it can be presumed that the second change was caused by a hole.

Figure 17:
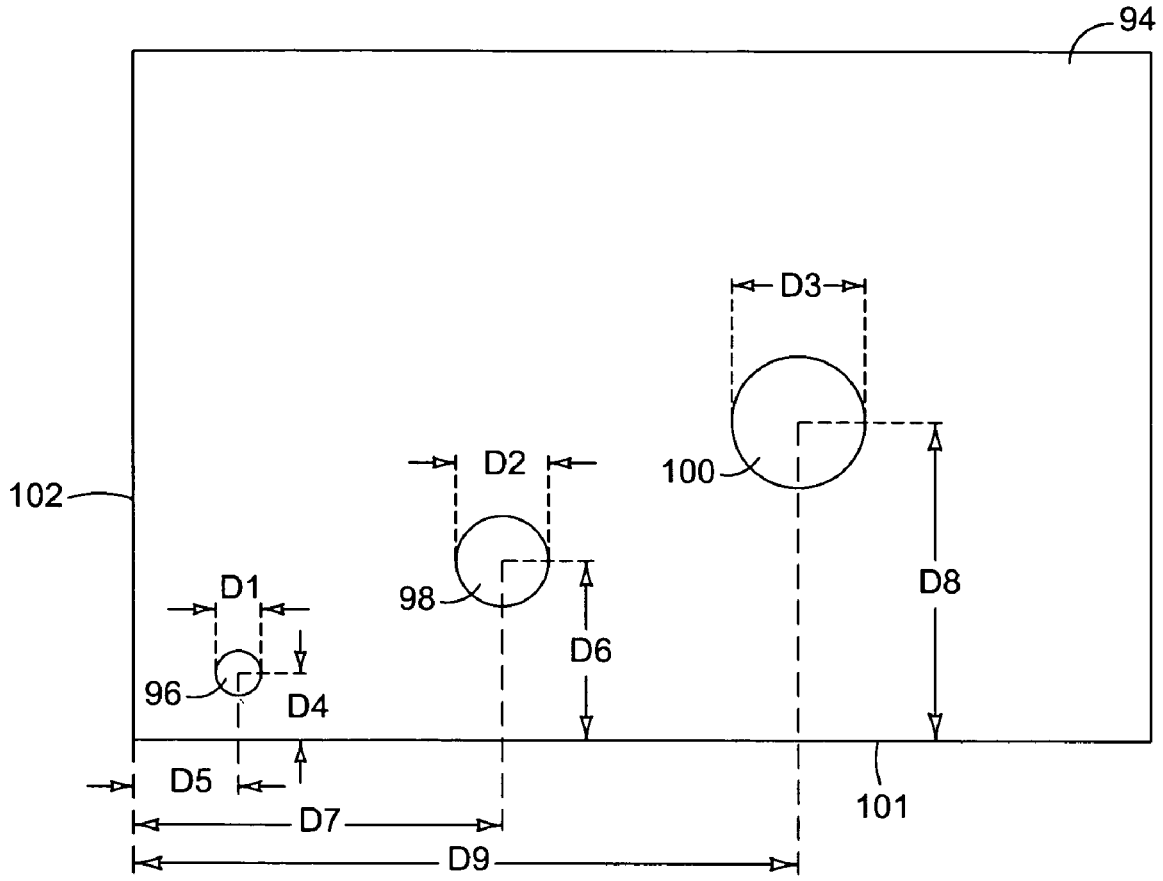
FIG. 17 illustrates an exemplary media sheet having variously placed and sized holes.

LOCATING HOLES: FIGS. 17–21 help illustrate a method for locating holes in print media based on collected intensity data. FIG. 17 illustrates media sheet 94 having variously sized and located holes 96–100. Hole 96 has a diameter D1. Hole 98 has a diameter D2, and hole 100 has a diameter D3. Measured from its center, hole 96 has a side edge distance D4 (distance from side edge 101) and is located a distance D5 from leading edge 102. Hole 98 has a side edge distance D6 and is located a distance D7 from leading edge 102. Hole 100 has a side edge distance D8 and is located a distance D9 from leading edge 102.

Figure 18:
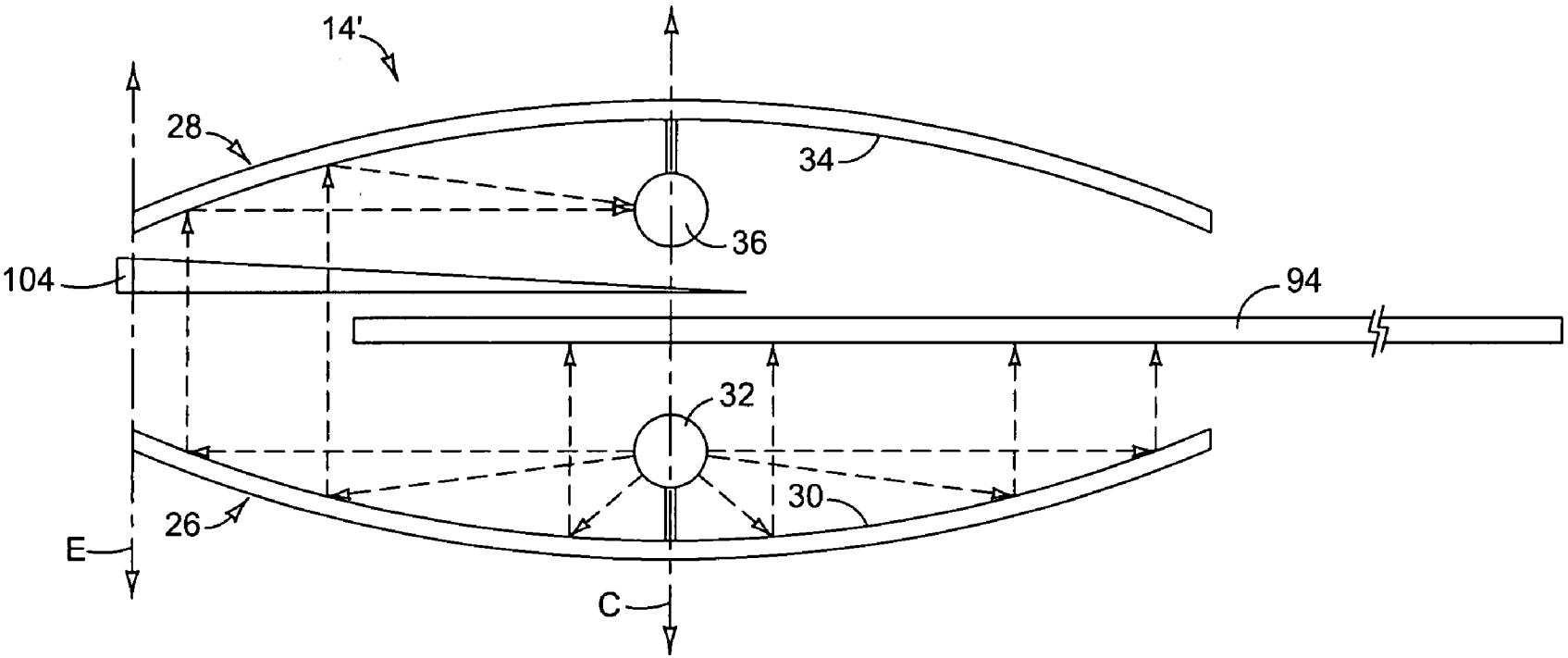
FIG. 18 is a side view of an exemplary filtered parabolic emitter and parabolic detector according to an embodiment of the present invention.

FIG. 18 shows media sheet 94 (FIG. 17) passing through sensor 14'. Sensor 14' has been modified to include filter 104. As will be shown, filter 104 causes a hole with a greater side edge distance to affect a larger change in measured intensity than a hole with a smaller side edge distance. Filter 104 represents generally any structure or any modification to emitter 26 or detector 28 that decreases the amount of light that is allowed to reach light detector 36 as a function of where that light crosses the media path. Using FIG. 18 as an example, light that is reflected to light detector 36 from a point on reflector 34 that is closer to center line C will be blocked less than light that is reflected to light detector 36 from a point on reflector 34 that is closer to edge line E. The degree to which filter 104 blocks light may, for example, vary linearly along a line intersecting line E and center line C. In the example of FIG. 18, a light beam directed by emitter 26 whose intensity is detected by detector 28 can be referred to as a filtered light beam.

Figure 19:
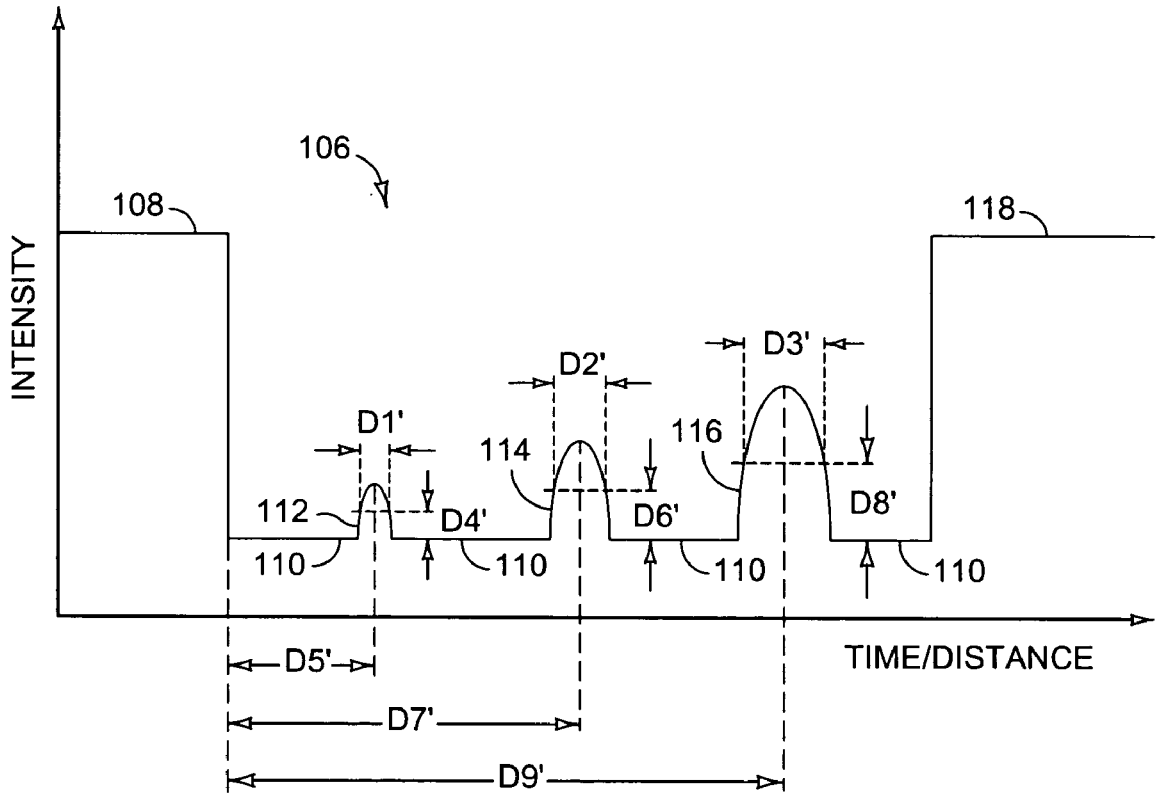
FIG. 19 is an exemplary two dimensional graph charting a change in intensity caused by variously placed and sized holes as the media sheet of FIG. 17 passes between the exemplary filtered parabolic emitter and parabolic detector of FIG. 18 according to an embodiment of the present invention.

FIG. 19 is a two-dimensional graph 106 illustrating a measured intensity level as a media sheet 94 (FIG. 17) with three variously sized and located holes passes through sensor 14' (FIG. 18). Initially y the measured intensity level is at a relatively high value 108. Referring to FIGS. 17–19 together, when a leading edge of a media sheet 94 enters sensor 14' (FIG. 18), the measured intensity level drops to a relatively low value 110. Intensity change 112 corresponds to hole 96 (FIG. 17). Intensity change 114 corresponds to hole 98 (FIG. 17), and intensity change 116 corresponds to hole 100 (FIG. 17). Once the trailing edge exits sensor 14' (FIG. 18), the measured intensity returns to a relatively high value 118.

Focusing on FIG. 19, intensity change 112 has dimensions D4', D1' and D5'. D4' corresponds to fifty percent of its magnitude. D1' corresponds to its width at the fifty-percent magnitude level. D5' corresponds to the time between when the leading edge of the media sheet entered sensor 14' and when intensity change 112 reached its peak magnitude.

Referring back to FIG. 17, side edge distance D4 can be calculated as a function of D4' (FIG. 19). The two will vary by a linear factor that depends primarily on the slope of filter 104 (FIG. 18) and the intensity of the light beam from emitter 26 (FIG. 18). In one embodiment of a prototype apparatus, this factor was empirically determined to be 2.68 mv/mm, where the intensity change was measured in volts.

Where the velocity of media sheet 94 is known, D1' and D5' can be converted to linear distances D1" and D5". Referring to FIG. 17, hole diameter D1 can be calculated as a function of D1". D1" equals approximately eighty-six percent of D1. Leading edge distance D5 then equals D5".

Focusing again on FIG. 19, intensity change 114 has dimensions D2', D6' and D7'. D6' corresponds to fifty percent of its magnitude. D2' corresponds to its width at the fifty-percent magnitude level. D7' corresponds to the time between when the leading edge of the media sheet entered sensor 14' and when intensity change 114 reached its peak magnitude.

Referring back to FIG. 17, side edge distance D6 can be calculated as a function of D6' (FIG. 19). The two will vary by a linear factor that depends primarily on the slope of filter 104 (FIG. 18) and the intensity of emitter 26 (FIG. 18). In one embodiment of a prototype apparatus, this factor was empirically determined to be 2.68 mv/mm, where the intensity change was measured in volts.

Where the velocity of media sheet 94 is known, D2' and D7' can be converted to linear distances D2" and D7." Referring to FIG. 17, hole diameter D2 can be calculated as a function of D2". D2" equals approximately eighty-six percent of D2. Leading edge distance D7 then equals D7".

Focusing once again on FIGS. 17–19, intensity change 116 has dimensions D8', D3' and D9'. D8' corresponds to fifty percent of its magnitude. D3' corresponds to its width at the fifty-percent magnitude level. D9' corresponds to the time between when the leading edge of the media sheet entered sensor 14' and when intensity change 116 reached its peak magnitude.

Referring back to FIG. 17, side edge distance D8 can be calculated as a function of D8' (FIG. 19). The two will vary by a linear factor that depends primarily on the slope of filter 104 (FIG. 18) and the intensity of emitter 26 (FIG. 18). In one embodiment of a prototype apparatus, this factor was empirically determined to be 2.68 mv/mm, where the intensity change was measured in volts.

Where the velocity of media sheet 94 is known, D3' and D9' can be converted to linear distances D3" and D9". Referring to FIG. 17, hole diameter D3 can be calculated as a function of D3". D3" equals approximately eighty-six percent of D3. Leading edge distance D9 then equals D9".

Figure 20:
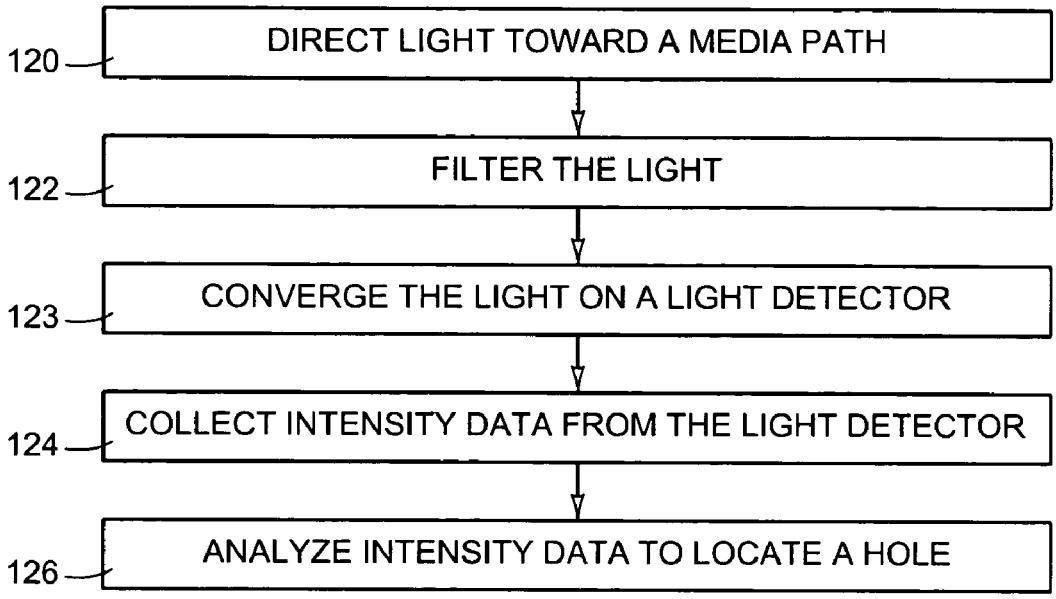
FIG. 20 is an exemplary flow diagram illustrating steps taken to locate a hole according to an embodiment of the present invention.

Moving on, FIG. 20 is an exemplary flow diagram illustrating method steps for locating a hole. Light is directed toward a media path (step 120). The light is directed from a first side of a media path such that the spans at least a portion of a width of the media path. The light is filtered (step 122). The light is converged on a light detector (step 123). Intensity data is collected from the light detector (step 124). The intensity data collected corresponds to an intensity measured from a second side of the media path opposite the first side as print media is urged along the media path. The intensity data is analyzed to locate a hole (step 126).

Figure 21:
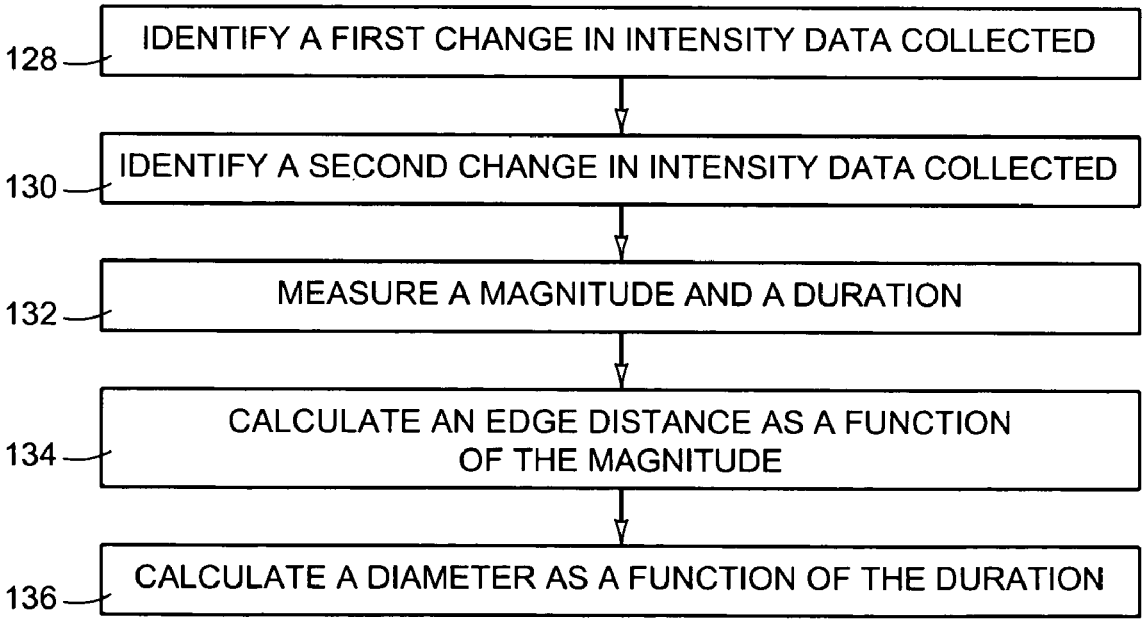
FIG. 21 is an exemplary flow diagram illustrating steps taken to identify a location and size of a hole based on a change in intensity caused by that hole according to an embodiment of the present invention.

FIG. 21 is an exemplary flow diagram expanding on step 124. A first change in intensity data collected is noted (step 128). The first change, for example, may be a change from a relatively high value to a relatively low value indicating that the leading edge of a media sheet has been detected. A second change in the collected intensity data is then noted (step 130). The second change, for example, may be an increase from the relatively low value to a value less than the relatively high value and then a return to the relatively low value. The magnitude of the second change and a duration of the second change at fifty percent of its magnitude are measured (step 132). An edge distance is calculated as a function of the measured magnitude (step 134). A diameter is calculated as a function of the measured duration (step 136).

CONCLUSION: The illustration of FIG. 1 show the architecture, functionality, and operation of an exemplary environment in which various embodiments of the present invention may be implemented. FIGS. 2–8 and 18 illustrate various embodiments of a sensor. The claimed subject matter is not limited to the embodiments shown. The sensor may be able to detect the intensity of a light directed across a portion of a width of a media path. The block diagram of FIG. 9 illustrates an example of the logical components that can be used to implement the various embodiments. Each block in FIG. 9 may represent in whole or in part a module, segment, or portion of code that comprises one or more executable instructions to implement the specified logical function(s). Each block may represent a circuit or a number of interconnected circuits to implement the specified logical function(s).

Also, embodiments of the present invention can include any computer-readable medium for use by or in connection with an instruction execution system such as a computer/processor based system or an ASIC (Application Specific Integrated Circuit) or other system that can fetch or obtain the logic from computer-readable media and execute the instructions contained therein. "Computer-readable medium" can be any of one or more computer readable media that can contain, store, or maintain programs and data for use by or in connection with the instruction execution system. Computer readable media can comprise any one of many physical media such as, for example, electronic, magnetic, optical, electromagnetic, infrared, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

Although the flow diagrams of FIGS. 12, 15, 16, 20, and 21 show specific orders of execution, the orders of execution may differ from that which is depicted. For example, the order of execution of two or more blocks may be scrambled relative to the orders shown. Also, two or more blocks shown in succession may be executed concurrently or with partial concurrence. All such variations are within the scope of the claimed subject matter.

Embodiments of the present invention have been shown and described with reference to the foregoing exemplary embodiments. It is to be understood, however, that other forms, details, and embodiments may be made without departing from the spirit and scope of the invention which is defined in the following claims.

What is claimed is:

1. A method for determining a media feature, comprising:

reflecting light, emitted by an emitter, from a first reflector, positioned on a first side of a media path, toward the media path;

reflecting the light from a second reflector, positioned on a second side of the media path opposite the first side, to converge the light on a detector;

collecting intensity data from the detector; and analyzing the intensity data to determine the media feature.

2. The method of claim 1, wherein analyzing comprises analyzing the intensity data to determine a width of the media.

3. The method of claim 2, wherein:

the presence of the media in the media path blocks at least a portion of the light causing a change in intensity data collected;

analyzing comprises determining the width of the media according to the change.

4. The method of claim 1, wherein analyzing comprises analyzing the intensity data to identify a presence of a hole in the media.

5. The method of claim 4, wherein:

the presence of the media in the media path blocks at least a portion of the light causing a first change in the intensity data collected;

the presence of a hole in the print media causes a second change in the intensity data collected;

analyzing comprises identifying the presence of the hole according to characteristics of the second change.

6. The method of claim 5, wherein analyzing includes:

measuring a magnitude and a duration corresponding to the second change;

ascertaining a suspected diameter corresponding the magnitude;

ascertaining a width corresponding to the duration; and comparing the suspected diameter to the width to determine if the second change represents a hole.

7. The method of claim 6, wherein measuring a duration comprises measuring a duration for which the second change remains equal to or greater than fifty percent of the magnitude, the method further comprising determining that the second change represents a hole when the comparison reveals that the width equals about eighty-six percent of the suspected diameter.

8. The method of claim 1, further comprising filtering the light along at least a portion of a width of the media path, and wherein:

collecting comprises collecting filtered intensity data; and analyzing comprises analyzing the filtered intensity data to identify a location of a hole in the media.

9. The method of claim 8, wherein:

the presence of the media in the media path blocks at least a portion of the light causing a first change in the intensity data collected;

the presence of a hole in the media causes a second change in the intensity data collected;

analyzing comprises measuring characteristics of the second change to identify the location of the hole.

10. The method of claim 9, wherein analyzing includes measuring a magnitude of the second change and calculating a side edge distance according to the magnitude.

11. The method of claim 10, wherein analyzing includes measuring a duration of the second change and calculating a hole diameter according to the duration and the magnitude of the second change.

12. A system for determining a media feature, comprising:

an emitter operable to emit light;

a detector operable to detect light intensity;

a first reflector positioned on a first side of a media path and configured to reflect light from the emitter toward the media path;

a second reflector positioned on a second side of the media path opposite the first side, the second reflector configured to converge the light on the detector;

sensor logic to collect intensity data from the detector; and evaluation logic to analyze the intensity data to determine the media feature.

13. The system of claim 12, wherein the first and second reflectors are parabolic reflectors.

14. The system of claim 12, wherein:

introduction of media in the media path between the first and second reflectors blocks at least a portion of the light reflected by the first reflector causing a change in intensity data collected; and the evaluation logic is operable to detect the change and determine a width of the media according to the change.

15. The system of claim 12, wherein:

introduction of the media in the media path between the first and second reflectors blocks at least a portion of the light reflected by the first reflector causing a first change in the intensity data collected;

a presence of a hole in the media in the media path between the first and second reflectors causes a second change in the intensity data collected; and the evaluation logic is operable to identify the presence of the hole according to characteristics of the second change.

16. The system of claim 12, further comprising a filter configured to filter the light along at least a portion of a width of the media path between the first and second reflectors, and wherein:

introduction of the media in the media path between the first and second reflectors blocks at least a portion of the light causing a first change in the intensity data collected;

a presence of a hole in the media in the media path between the first and second reflectors causes a second change in the intensity data collected; and the evaluation logic is operable to measure a magnitude and a duration of the second change and to calculate a side edge distance and a hole diameter according to the magnitude and the duration.

* * * * *